US008776897B2

(12) United States Patent
Vaghi et al.

(10) Patent No.: US 8,776,897 B2
(45) Date of Patent: Jul. 15, 2014

(54) METHOD AND APPARATUS FOR MULTI-DROP TOOL CONTROL

(75) Inventors: Francesco Vaghi, Houston, TX (US); Ives Loretz, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 232 days.

(21) Appl. No.: 12/983,406

(22) Filed: Jan. 3, 2011

(65) Prior Publication Data

US 2012/0168174 A1 Jul. 5, 2012

(51) Int. Cl.
*E21B 34/10* (2006.01)

(52) U.S. Cl.
USPC ..... 166/375; 166/72; 166/373

(58) Field of Classification Search
USPC ..... 166/375, 373, 72, 100; 175/59, 77; 73/152.23–152.28
See application file for complete search history.

(56) References Cited

U.S. PATENT DOCUMENTS

| | | | | |
|---|---|---|---|---|
| 4,636,934 | A | 1/1987 | Schwendemann et al. | |
| 6,109,357 | A | 8/2000 | Zimmerman | |
| 6,125,938 | A | 10/2000 | Garcia-Soule et al. | |
| 6,247,536 | B1 | 6/2001 | Leismer et al. | |
| 6,575,237 | B2 * | 6/2003 | Purkis et al. | 166/72 |
| 6,668,936 | B2 | 12/2003 | Williamson et al. | |
| 7,306,043 | B2 | 12/2007 | Toekje et al. | |
| 7,464,761 | B2 | 12/2008 | Hosatte et al. | |
| 7,730,953 | B2 | 6/2010 | Casciaro | |
| 7,748,461 | B2 | 7/2010 | Loretz et al. | |
| 2002/0007946 | A1 | 1/2002 | Purkis et al. | |
| 2004/0069491 | A1 | 4/2004 | Garay et al. | |
| 2009/0065218 | A1 * | 3/2009 | Loretz et al. | 166/375 |
| 2009/0243875 | A1 * | 10/2009 | Mandrou et al. | 340/854.9 |
| 2009/0283276 | A1 | 11/2009 | Mandrou et al. | |

FOREIGN PATENT DOCUMENTS

| | | | |
|---|---|---|---|
| WO | 0220942 | A1 | 3/2002 |
| WO | 0229205 | A1 | 4/2002 |

OTHER PUBLICATIONS

International Search Report and Written Opinion issued in PCT/US2011/066735 on Oct. 29, 2012, 12 pages.

* cited by examiner

*Primary Examiner* — Jennifer H Gay
*Assistant Examiner* — Taras P Bemko
(74) *Attorney, Agent, or Firm* — David J. Groesbeck; Brandon S. Clark

(57) ABSTRACT

A hydraulically balanced multiple drop well completion has a plurality of hydraulic control lines each of which communicates hydraulic inputs and a plurality of hydraulically operated tools numbering greater than or equal to the number of hydraulic control lines. Each of the hydraulic control lines is connected to at least one of the hydraulically operated tools to communicate hydraulic inputs to actuate the hydraulically operated tools. Each of the hydraulically operated tools discharges hydraulic fluid to one of the hydraulic control lines other than the hydraulic control line from which it receives the controlling hydraulic input.

20 Claims, 4 Drawing Sheets

FIG. 4

| Cycle # (Input Signal in CL 24a) | Assembly 30a Zone 16a | Assembly 30b Zone 16b |
|---|---|---|
| 1 | CLOSED | CLOSED |
| 2 | CLOSED | Pos 1 |
| 3 | CLOSED | Pos 2 |
| 4 | CLOSED | FULL OPEN |
| 5 | OPEN | CLOSED |
| 6 | OPEN | Pos 1 |
| 7 | OPEN | Pos 2 |
| 8 | OPEN | FULL OPEN |

FIG. 5

| Cycle # (Input Signal in CL 24b) | Assembly 30c Zone 16c | Assembly 30d Zone 16d |
|---|---|---|
| 1 | CLOSED | CLOSED |
| 2 | CLOSED | Pos 1 |
| 3 | CLOSED | Pos 2 |
| 4 | CLOSED | FULL OPEN |
| 5 | OPEN | CLOSED |
| 6 | OPEN | Pos 1 |
| 7 | OPEN | Pos 2 |
| 8 | OPEN | FULL OPEN |

METHOD AND APPARATUS FOR MULTI-DROP TOOL CONTROL

BACKGROUND

This section provides background information to facilitate a better understanding of various aspects of the invention. It should be understood that the statements in this section are to be read in this light, and not as admissions of prior art.

The invention relates in general to downhole (e.g., subsurface, subterranean) wellbore operations and, more specifically, to methods and apparatus for operating multiple, e.g., 2 or more, downhole hydraulic tools utilizing a minimal number of hydraulic lines.

To meet the increasing need for hydrocarbons, wells (e.g., subterranean wellbores) are being drilled deeper and in more hostile downhole environments. In many instances a single wellbore can penetrate multiple geological formations, or zones, from which fluid may be produced or injected. Often a large number of controllable downhole tools are required to realize the potential of these wells. The challenge of controlling downhole tools increases with the number of downhole tools utilized and the hostile wellbore environment. For example, electrical control systems are often unreliable and/or short-lived. High downhole temperatures often limit electrical control systems. The wellbore fluids, for example drilling fluids ("mud") and completion fluids, are often highly electrolytic and can adversely affect exposed electric circuits. Corrosive fluids in the well, such as hydrogen sulfide and carbon dioxide, attack electrical connections, conductors and insulators.

It has become common to deploy hydraulic control lines in subterranean wellbores to control the downhole tools. Packers, valves, and perforating guns are some of the downhole tool types that can be controlled by changes in pressure in the fluid contained in the hydraulic control lines. Typically the top end of each control line extends to the surface (land or sea floor) and is connected to a hydraulic pump that can control the pressure of the fluid inside the line. A control line must be passed through a feedthrough of a packer in order to extend the control line from the top to the bottom of the packer (or across the packer). Among others, a function of a packer is to seal the wellbore annulus across the packer. However, each time a control line is extended through a feedthrough, a potential leak path is created in the packer potentially allowing the seal created by the packer to fail. Still further, the limited space or pre-existing equipment in the wellbore may limit the number of hydraulic control lines and thus the number of controllable downhole tools that may be utilized.

Therefore, there is a continuing desire for hydraulic control methods and apparatus that provide for control of a multiplicity of downhole tools with a minimum number of hydraulic control lines from the surface. There is a still further desire for hydraulic control methods and apparatus that provide operational complexity of electric control systems, with only a few hydraulic inputs by use of hydraulic fluid flow, hydraulic fluid pressure oscillation, and hydraulic fluid pressure.

SUMMARY

According to one or more aspects of the invention, a well completion comprises a plurality of hydraulic control lines each of which communicates hydraulic inputs and a plurality of hydraulically operated tools numbering greater than or equal to the plurality of hydraulic control lines. Each of the plurality of hydraulically operated tools is operable between at least two positions solely through the hydraulic inputs and each of the plurality of hydraulically operated tools is connected to one of the plurality of control lines to receive the hydraulic inputs and connected to one of the other of the plurality of control lines to which hydraulic fluid is discharged. In at least one embodiment, each of the plurality of hydraulic control lines is connected to at least one of the plurality of hydraulically operated tools to communicate the hydraulic inputs to the at least one of the plurality of hydraulically operated tools.

In one embodiment at least two of the plurality of hydraulically operated tools can be connected to a common hydraulic control line of the plurality of hydraulic control lines to receive the hydraulic inputs. In another embodiment each of the plurality of hydraulically operated tools is connected to a different one of the plurality of hydraulic control lines than the other hydraulically operated tools to receive the hydraulic inputs.

In at least one embodiment, at least two of the plurality of hydraulically operated tools are connected to a common hydraulic control line of the plurality of hydraulic control lines to receive the hydraulic inputs, at least one of the at least two hydraulically operated tools having a different actuation sequence from at least another one of the at least two hydraulically operated tools.

According to another embodiment of the invention, a hydraulically balanced multi-drop well completion comprises a plurality of hydraulic control lines each of which communicates hydraulic inputs, and a plurality of piloted tool assemblies comprising a hydraulically piloted switch and a hydraulically operated tool. Each of the plurality of piloted tool assemblies is operable between at least two positions solely through the hydraulic inputs. Each of the plurality of piloted tool assemblies is connected to one of the plurality of control lines to receive the hydraulic inputs and connected to one of the other of the plurality of control lines to which hydraulic fluid is discharged.

In at least one embodiment, each of the plurality of hydraulic control lines is connected to at least one of the plurality of piloted tool assemblies to communicate the hydraulic inputs to the at least one of the plurality of piloted tool assemblies. In one embodiment, the plurality of hydraulic control lines is equal to the plurality of piloted tool assemblies and each of the plurality of piloted tool assemblies is connected to a different one of the plurality of hydraulic control lines than the other piloted tool assemblies of the plurality of the piloted tool assemblies to receive the hydraulic inputs. Each of the plurality of piloted tool assemblies has an actuation sequence responsive to the hydraulic inputs. In some embodiments at least two of the plurality of piloted tool assemblies have a different actuation sequence from one another.

In another embodiment, the plurality of hydraulic control lines number less than the plurality of piloted tool assemblies and each of the plurality of hydraulic control lines is connected to at least one of the plurality of piloted tool assemblies to communicate the hydraulic inputs to the at least one of the plurality of piloted tool assemblies.

An exemplary embodiment of a method for controlling multiple hydraulically operated tools deployed in a wellbore comprises operationally connecting a plurality of hydraulically operated tools to a plurality of hydraulic control lines numbering less than or equal to the plurality of hydraulically operated tools, wherein each of the hydraulically operated tools is operable between at least two positions solely through hydraulic inputs, and wherein each of the plurality of hydraulically operated tools is connected to one of the plurality of control lines to receive the hydraulic inputs and connected to one of the other of the plurality of hydraulic control lines to which hydraulic fluid is discharged; communicating the hydraulic input through one of the plurality of hydraulic control lines to at least one of the plurality of hydraulically operated tools; actuating, in response to receiving the hydraulic input, at least one of the plurality of hydraulically operated tools from one of the at least two positions; and discharging hydraulic fluid from the at least one of the hydraulically operated tools to one of the other of the plurality hydraulic control lines from which the hydraulic input was received.

The foregoing has outlined some of the features and technical advantages of the invention in order that the detailed description of the invention that follows may be better understood. Additional features and advantages of the invention will be described hereinafter which form the subject of the claims of the invention.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

FIGS. 4 and 5 show examples of actuation sequences of the hydraulic circuit of FIG. 3.

DETAILED DESCRIPTION

Figure 1:
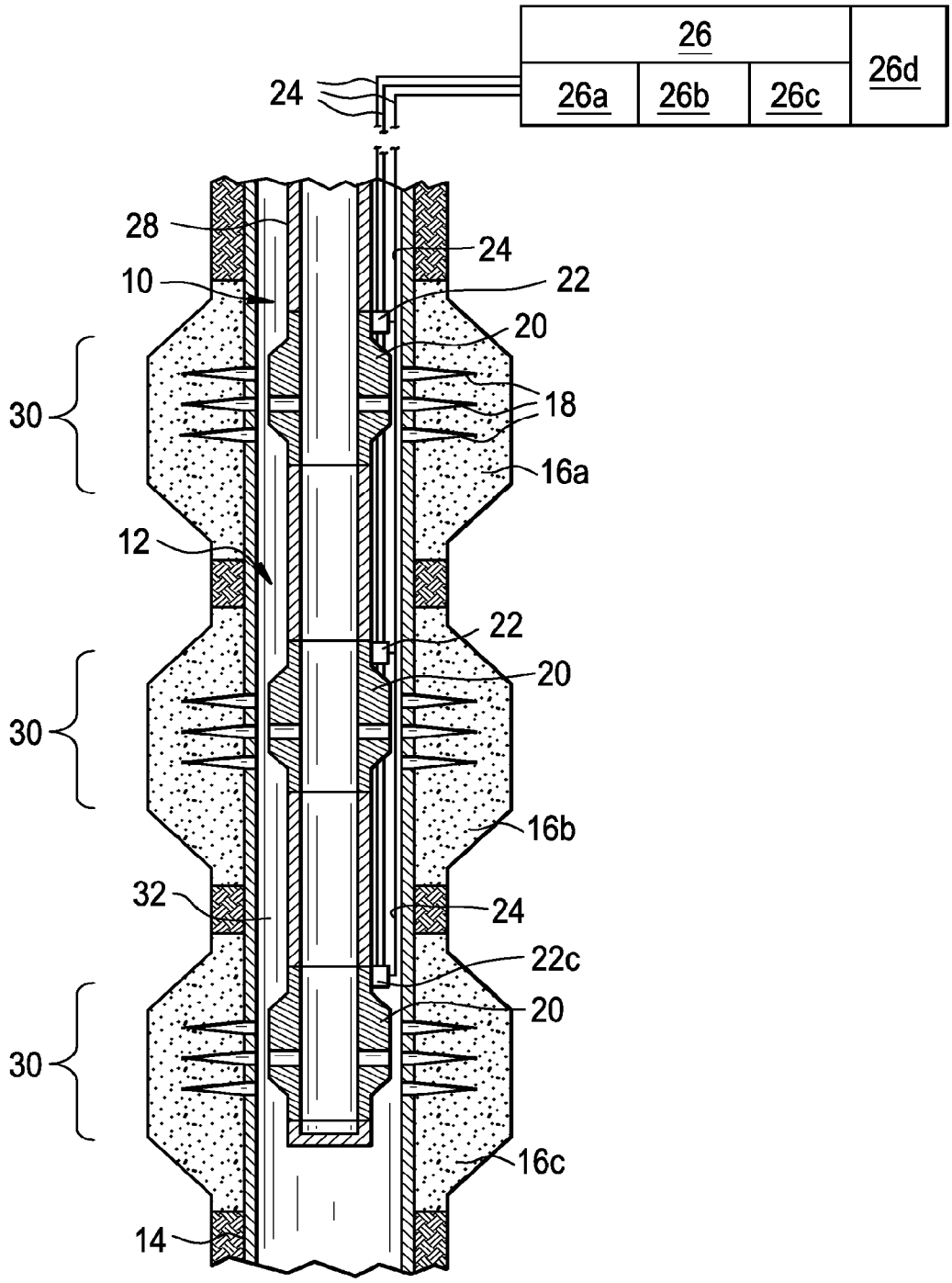
FIG. 1 is a well schematic of a hydraulically balanced multi-drop tool completion according to one or more aspects of the invention.

It is to be understood that the following disclosure provides many different embodiments, or examples, for implementing different features of various embodiments of the invention. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

As used herein, the terms "up" and "down"; "upper" and "lower"; "top" and "bottom"; and other like terms indicating relative positions to a given point or element are utilized to more clearly describe some elements. Commonly, these terms relate to a reference point as the surface from which drilling operations are initiated as being the top point and the total depth of the well being the lowest point, wherein the well (e.g., wellbore, borehole) is vertical, horizontal or slanted relative to the surface. The terms "pipe," "tubular," "tubular member," "casing," "liner," "tubing," "drill pipe," "drill string" and other like terms can be used interchangeably. The terms may be used in combination with "joint" to mean a single unitary length; a "stand" to mean one or more, and typically two or three, interconnected joints; or a "string" meaning two or more interconnected joints.

As used herein, the terms "up" and "down"; "upper" and "lower"; and other like terms indicating relative positions to a given point or element are utilized to more clearly describe some elements of the embodiments of the invention. Commonly, these terms relate to a reference point as the surface from which drilling operations are initiated as being the top point and the total depth of the well being the lowest point.

This disclosure is directed to a multi-drop wellbore completion that minimizes the number of hydraulic control lines utilized per hydraulically operated downhole tool. According to one or more aspects of the invention, the multi-drop tool completion comprises one or fewer hydraulic control lines per hydraulically operated tool. According to one or more aspects of the invention, the multi-drop tool completion is hydraulically balanced wherein the hydraulic fluid is not vented from the hydraulically downhole tool into the wellbore environment. According to one or more aspects of the invention, the hydraulically operated downhole tools are not biased to the geological formation pressures or tubing pressure. According to one or more aspects of the invention, the hydraulically operated downhole tools are substantially unlimited in regard to setting depth limitations.

FIG. 1 illustrates an embodiment of a hydraulically balanced multi-drop tool completion, generally denoted by the numeral 10, deployed in a wellbore 12. Wellbore 12, completed with casing 14, penetrates multiple geological zones of interest 16*a*, 16*b*, and 16*c*. FIG. 1 depicts perforations (e.g., tunnels) 18 formed through casing 14 into the geological zones of interest 16*a*, 16*b*, and 16*c*.

Hydraulically balanced multi-drop tool completion 10 comprises multiple (e.g., 2 or more) hydraulically operated (e.g., actuated) downhole tools 20 deployed in wellbore 12. In the depicted embodiment, downhole tools 20 are deployed on a pipe string 28 (e.g., joint tubing, coiled tubing, etc.). Hydraulically operated tools 20 include without limitation subsurface safety valves, sliding sleeves, locking or latching devices, packers, packer setting tools, expansion joints, flow control devices (e.g., valves), switching devices, artificial lift devices (e.g., gas lift valves), and isolation valves. For purposes of brevity in description, hydraulically operated downhole tools 20 are depicted and described herein as flow control devices (e.g., valves) each having at least two operational states, or positions (e.g., open and close); however, it should be understood that any device that may be actuated from one position to another position may be utilized. Each of the hydraulically operated tools 20 can be controlled solely through hydraulic inputs.

Each hydraulically operated downhole tool 20 comprises a hydraulic switch 22 (e.g., hydraulic piloted switch valve), forming a hydraulically piloted tool assembly 30. Hydraulic switches 22 are hydraulically piloted devices that provide the desired settings for the associated hydraulically operated downhole tool 20 in response to a hydraulic input signal (e.g., a pressure change or cycle). A control line 24 operationally connects the hydraulically piloted tool assembly 30 to a hydraulic pressure source 26, typically positioned at the surface. Hydraulic pressure source 26, which may be a discrete or variable setting source, can include for example hydraulic fluid 26*a*, pump(s) 26*b*, valve(s) 26*d*, and electronic control equipment 26*c*. Operation of hydraulic switches and the operationally connected hydraulically operated downhole tools is known in the art. Examples of such operation can be found, for example, in U.S. Pat. Nos. 7,748,461, and 7,306, 043, each of which is incorporated herein and owned by the assignee of the invention disclosed herein. Each of the hydraulically piloted tool assemblies can be operated between it's at least two positions solely through hydraulic inputs communicated from a hydraulic control line. Hydraulic multi-drop tool completion 10 does not require an electric line or electrical source to operate hydraulically piloted tool assemblies 30. According to one or more aspects of the invention, hydraulically multi-drop tool completion 10 comprises a plural number of hydraulically piloted tool assemblies and a plural number of hydraulic control lines equal to or less than the number of hydraulically piloted tool assemblies; wherein each of the hydraulically piloted tool assemblies is connected to one of the plural number of hydraulic control lines to receive the hydraulic input and connected to one of the other of the plural number of hydraulic control lines through which hydraulic fluid discharged from the piloted tool assembly is returned and not vented to the wellbore (e.g., annulus 32).

Figure 2:
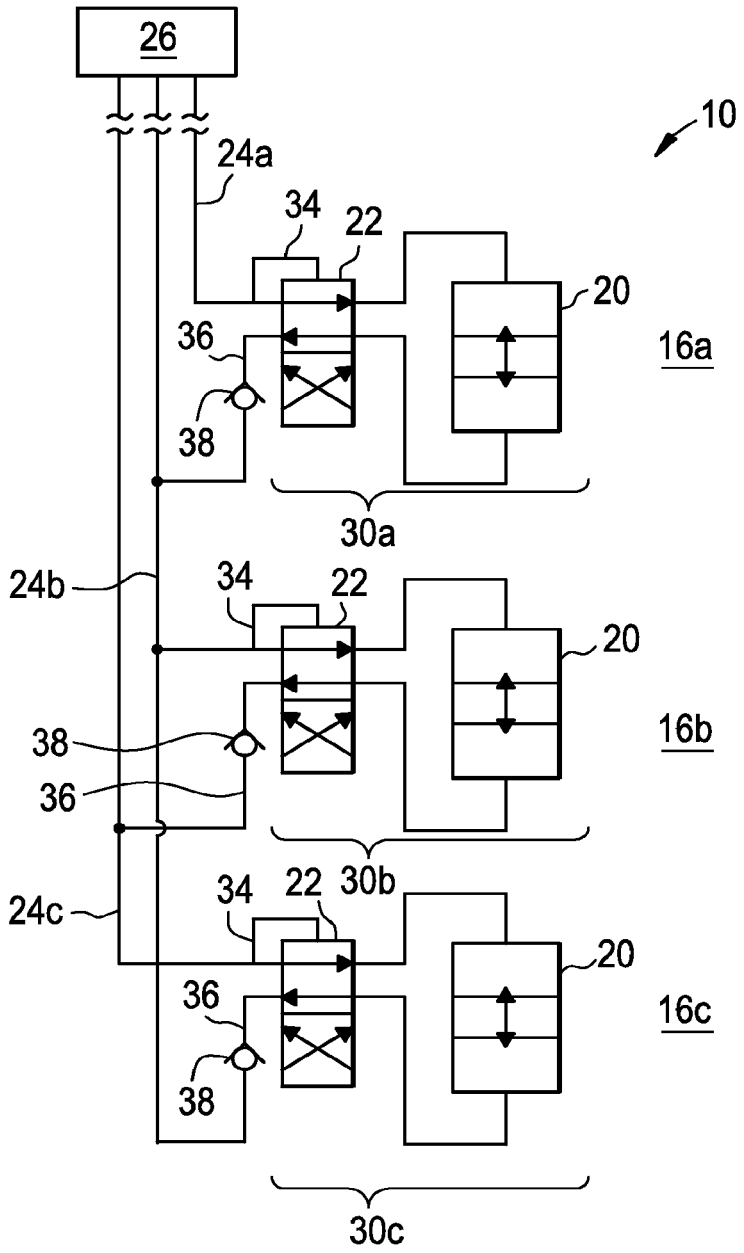
FIG. 2 is a schematic diagram of an exemplary embodiment of a hydraulic circuit of the hydraulically balanced multi-drop tool completion of FIG. 1.

FIG. 2 is a schematic diagram of an exemplary embodiment of a hydraulic circuit of hydraulically balanced multi-drop tool completion 10 depicted in FIG. 1. Depicted multi-drop tool completion 10 is a hydraulically balanced system having a plurality of hydraulically piloted tool assemblies 30 (FIG. 1), indentified individually as 30*a*, 30*b*, 30*c* in FIG. 2, and a plurality of hydraulic control lines 24 (FIG. 1), indentified individually as 24*a*, 24*b*, 24*c* in FIG. 2, equal to or less than the plurality of hydraulically piloted tool assemblies. In this embodiment there are an equal number of hydraulically piloted tool assemblies and hydraulic control lines. Each of the plurality of hydraulic control lines communicates controlling hydraulic inputs to at least one of the hydraulically piloted tool assemblies.

Hydraulic control line 24*a* operationally connects hydraulic source 26 to piloted tool assembly 30*a* to receive a hydraulic input signal (e.g., pressure change, pressure cycle) induced in control line 24*a* by hydraulic source 26 that produce an actuation in the associated hydraulic switch 22. Each actuation in hydraulic switch 22 may activate, deactivate, or change the setting or position of corresponding hydraulic downhole tool 20 depending on the setting of hydraulically piloted tool assembly 30*a*. For example, a hydraulic input signal (e.g., pressure change, pressure cycle, pressure oscillation) is induced in hydraulic control line 24*a* and communicated through pilot line 34 to hydraulic switch 22, actuating hydraulic switch 22 to a position (e.g., setting), which in one example, communicates hydraulic pressure from control line 24*a* to downhole tool 20 thereby shifting downhole tool 20 to the next position (e.g., full open, full closed, partially open, etc.). In response to actuating downhole tool 20 to the next position, biasing hydraulic fluid is discharged from downhole tool 20 through hydraulic switch 22 into return line 36 to control line 24*b*, which is one of the plurality of hydraulic control lines other than the one supplying the hydraulic input signal to piloted tool assembly 30*a*. A one-way valve 38 (e.g., check valve) is positioned in return line 36 allowing hydraulic fluid vented from downhole tool 20*a* to flow only in the direction of control line 24*b*.

Hydraulically piloted tool assemblies 30*b* and 30*c* operate in similar fashion as described above with reference to hydraulically piloted tool assembly 30*a*. In this embodiment, hydraulic control line 24*b* communicates hydraulic inputs from source 26 to piloted tool assembly 30*b* and the hydraulic fluid displaced during operation of the associated downhole tool 20 is discharged through return line 36 and check valve 38 to one of the other hydraulic control lines than the one that supplies the controlling hydraulic input, hydraulic control line 24*c* in this embodiment. Similarly, hydraulic control line 24*c* supplies hydraulic inputs from hydraulic source 26 to operate piloted tool assembly 30*c* and the hydraulic fluid displaced during operation of the associated downhole tool 20 is discharged through return line 36 and check valve 38 to hydraulic control line 24*b*, which is one of the other of the plurality of control lines that does not supply hydraulic inputs to piloted tool assembly 30*c*.

Figure 3:
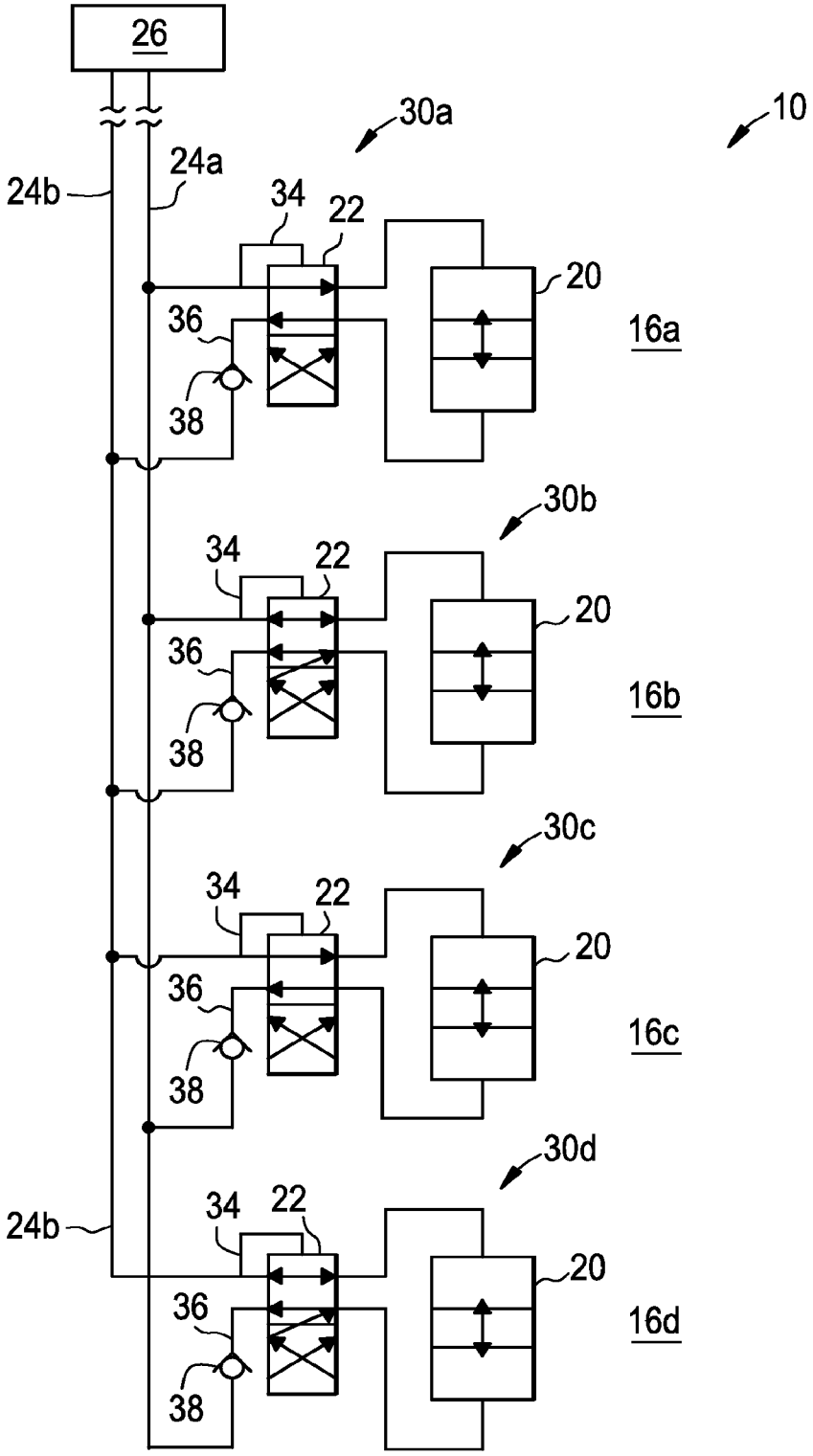
FIG. 3 is a schematic diagram of another exemplary embodiment of a hydraulic circuit of a hydraulically balanced multi-drop tool completion according to one or more aspects of the invention.

FIG. 3 is a schematic diagram of another embodiment of a hydraulic circuit of an embodiment of a hydraulically balanced multi-drop tool completion 10 according to one or more aspects of the invention. In this embodiment, hydraulically balanced multi-drop tool completion 10 utilizes fewer hydraulic control lines than hydraulically piloted tool assemblies. Thus, hydraulically balanced multi-drop completion 10 comprises a plurality of hydraulic control lines that is less than the plurality of hydraulically piloted tool assemblies. Similar to the embodiment depicted in FIG. 2, hydraulic fluid displaced from tool assemblies 30 (FIG. 1), referred to individually as 30*a*, 30*b*, 30*c*, 30*d* in FIGS. 3-5, is returned to the hydraulic source 26 (e.g., surface (FIG. 1)) via one of the plurality of hydraulic control lines and is not vented to the wellbore. In particular, each of the plurality of piloted tool assemblies discharges hydraulic fluid to one of the plurality of hydraulic control lines other than the hydraulic control line from which it receives the hydraulic input signal. Each of the plurality of hydraulic control lines communicates controlling hydraulic inputs to at least one of the hydraulically piloted tool assemblies.

In this embodiment, hydraulic source 26 is operationally connected through control line 24*a* to piloted tool assembly 30*a*, depicted associated with a zone 16*a*, and piloted tool assembly 30*b*, depicted associated with zone 16*b*. Control line 24*b* operationally connects hydraulic source 26 to piloted tool assembly 30*c*, depicted associated with a zone 16*c*, and piloted tool assembly 30*d*, depicted associated with zone 16*d*. Downhole tool 20 of respective tool assemblies 30*a*, 30*c* are depicted as 2-position, on-off valves (e.g., full open, full closed) and downhole tool 20 of respective tool assemblies 30*b*, 30*d* are depicted as 4-position valves (e.g., full open, full closed, position 1 partially open, and position 2 partially open).

In the depicted embodiment, an input signal (e.g., change in pressure, pressure cycle) induced in control line 24*a* by hydraulic source 26 produces an actuation in hydraulic switches 22 of tool assemblies 30*a* and 30*b* which may change (e.g., actuate) the corresponding valve 20 position. Hydraulic fluid discharged from actuation of valves 20 of tool assemblies 30*a*, 30*b* is vented through the respective return lines 36 to control line 24*b*. FIG. 4 shows an example of an actuation sequence of tool assemblies 30*a* and 30*b* (e.g., zones 16*a*, 16*c*) of the embodiment of multi-drop tool completion 10 depicted in FIG. 3. The operational position of each tool assembly is described in terms of the operational position of the associated valve 20.

Operation of tool assemblies 30*c* and 30*d* is provided through the connection of control line 24*b* to hydraulic source 26 in the same manner as described with reference to tool assemblies 30*a*, 30*b* of FIG. 3. Hydraulic fluid discharged from actuation of valves 20 of tool assemblies 30*c*, 30*d* is discharged through the respective return lines 36 to control line 24*a*. FIG. 5 shows an example of an actuation sequence of hydraulically piloted tool assemblies 30*c*, 30*d* of multi-drop tool completion 10 depicted in FIG. 3. The operational position of each tool assembly is described in terms of the operational position of the associated valve 20.

The embodiment depicted in FIGS. 3-5 is configured to have 8 pressure cycles (e.g., input signal, pressure change) in the actuation sequence of tool assemblies 30*a*, 30*b*, 30*c*, and 30*d*. The actuation sequence of tool assemblies 30*c* and 30*d* depicted in FIG. 5 is the same as the actuation sequence of tool assemblies 30*a* and 30*b* depicted in FIG. 4.

An example of operation of hydraulically balanced multi-drop tool completion 10 is now described with specific reference to tool assemblies 30*a*, 30*b* and FIGS. 3 and 4. Upon the first pressure cycle induced in control line 24*a* by pressure source 26, piloted tool assembly 30*a* and 30*b* are both in the "closed" position. Upon the second pressure cycle (e.g., received hydraulic input signal), piloted tool assembly 30*a* remains in the "closed" position and piloted tool assembly 30*b* is actuated to "Pos 1" wherein the associated valve 20 is operated to a partially opened (e.g., choked) position. Upon the third pressure cycle, piloted tool assembly 30*a* remains in the "closed" position and piloted tool assembly 30*b* is actuated to "Pos 2" corresponding to a partially opened position that may be opened a different percentage than "Pos 1" for example. Upon the fourth pressure cycle, piloted tool assembly 30*a* remains in the "closed" position and piloted tool assembly 30*b* is actuated to a "full open" position. Upon the fifth pressure cycle, the 2-position valve 20 of piloted tool assembly 30*a* is actuated to the "open" position and piloted tool assembly 30*b* is actuated to the "closed" position. The remaining permutations of pressure cycles 6-8 are clear from FIGS. 3 and 4. Similarly, the operation and actuation of tool assemblies 30*c*, 30*d* is clear from FIGS. 3 and 5.

With reference to FIGS. 3 and 4, hydraulic fluid may be discharged from piloted tool assembly 30*a* through return line 36 to control line 24*b*, which is different from control line 24*a* that supplies the hydraulic input signal to piloted tool assembly 30*a*, upon actuating piloted tool assembly 30*a* from the closed position to the open position (cycle 5), and from the open position to the closed position (cycle 1). Hydraulic fluid may be discharged from piloted tool assembly 30*b* through a return line 36 to control line 24*b* upon each cycle depicted in the embodiment of FIG. 4.

With reference to FIGS. 3 and 5, hydraulic fluid may be discharged from piloted tool assembly 30*c* through return line 36 to control line 24*a* for example upon actuating piloted tool assembly 30*c* from the closed position to the open position (cycle 5), and from the open position to the closed position (cycle 1). Hydraulic fluid may be discharged from piloted tool assembly 30*d* through a return line 36 to control line 24*a* upon each cycle depicted in the embodiment of FIG. 5.

It will be understood by those skilled in the art with benefit of the present disclosure that the settings of each downhole tool 20 can be varied from those described above, depending on the completion, wellbore, and desires of the user. For instance, the hydraulic switches 22 can be constructed and configured so that its settings change only a limited number of times per pert total number of pressure changes or cycles. Any of the settings for valves can range from full open to full closed and any number of intermediate positions with variable percentage of partially opened desired.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure, and that they may make various changes, substitutions and alterations herein without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A well completion, comprising:

a plurality of hydraulic control lines each of which communicates hydraulic inputs; and a plurality of hydraulically operated tools numbering greater than or equal to the plurality of hydraulic control lines, each of the plurality of hydraulically operated tools operable between at least two positions solely through the hydraulic inputs, wherein each tool of the plurality of hydraulically operated tools is connected to only one of the plurality of control lines to receive the hydraulic inputs, the only one of the plurality of control lines being used to provide all hydraulic inputs, and connected to one of the other of the plurality of control lines to which hydraulic fluid is discharged without venting the hydraulic fluid to a surrounding wellbore environment.

2. The well completion of claim 1, wherein each of the plurality of hydraulic control lines is connected to at least one of the plurality of hydraulically operated tools to communicate the hydraulic inputs to the at least one of the plurality of hydraulically operated tools.

3. The well completion of claim 1, wherein at least two of the plurality of hydraulically operated tools are connected to a common hydraulic control line of the plurality of hydraulic control lines to receive the hydraulic inputs.

4. The well completion of claim 3, wherein each of the plurality of hydraulic control lines is connected to at least one of the plurality of hydraulically operated tools to communicate the hydraulic inputs to the at least one of the plurality of hydraulically operated tools.

5. The well completion of claim 1, wherein at least one of the plurality of hydraulically operated tools is operable between three or more positions.

6. The well completion of claim 1, wherein each of the plurality of hydraulically operated tools is connected to a different one of the plurality of hydraulic control lines than the other hydraulically operated tools of the plurality of hydraulically operated tools to receive the hydraulic inputs.

7. The well completion of claim 1, wherein at least one of the plurality of hydraulically operated tools is a flow control device.

8. The well completion of claim 1, wherein at least two of the plurality of hydraulically operated tools are connected to a common hydraulic control line of the plurality of hydraulic control lines to receive the hydraulic inputs, at least one of the at least two hydraulically operated tools having a different actuation sequence from the at least one of the other of the at least two hydraulically operated tools.

9. A hydraulically balanced multiple tool completion, comprising:

a plurality of hydraulic control lines each of which communicates hydraulic inputs; and a plurality of piloted tool assemblies comprising a hydraulically piloted switch and a hydraulically operated tool, each of the plurality of piloted tool assemblies operable between at least two positions solely through the hydraulic inputs, wherein each piloted tool assembly of the plurality of piloted tool assemblies is connected to only one of the plurality of control lines to receive the hydraulic inputs, the only one of the plurality of control lines being used to provide all hydraulic inputs, and connected to one of the other of the plurality of control lines to which hydraulic fluid is discharged without venting hydraulic fluid to a surrounding wellbore environment.

10. The completion of claim 9, wherein each of the plurality of hydraulic control lines is connected to at least one of the plurality of piloted tool assemblies to communicate the hydraulic inputs to the at least one of the plurality of piloted tool assemblies.

11. The completion of claim 9, wherein:

the plurality of hydraulic control lines is equal to the plurality of piloted tool assemblies; and each of the plurality of piloted tool assemblies is connected to a different one of the plurality of hydraulic control lines than the other piloted tool assemblies of the plurality of the piloted tool assemblies to receive the hydraulic inputs.

12. The completion of claim 11, the plurality of hydraulically operated tools comprises a flow control device.

13. The completion of claim 9, wherein:

the plurality of hydraulic control lines number less than the plurality of piloted tool assemblies; and each of the plurality of hydraulic control lines is connected to at least one of the plurality of piloted tool assemblies to communicate the hydraulic inputs to the at least one of the plurality of piloted tool assemblies.

14. The completion of claim 13, wherein:

each of the plurality of piloted tool assemblies has an actuation sequence responsive to the hydraulic inputs; and at least two of the plurality of piloted tool assemblies have a different actuation sequence from one another.

15. The completion of claim 13, wherein at least two of the plurality of piloted tool assemblies are connected to a common hydraulic control line of the plurality of hydraulic control lines to receive the hydraulic inputs.

16. The completion of claim 15, wherein:

each of the plurality of piloted tool assemblies has an actuation sequence responsive to the hydraulic inputs; and at least one of the at least two piloted tool assemblies connected to the common hydraulic control line has a different actuation sequence from at least one of the other of the at least two piloted tool assemblies.

17. The completion of claim 16, wherein at least one of the at least two piloted tool assemblies is operable between three or more positions.

18. A method for controlling multiple hydraulically operated tools deployed in a wellbore, comprising:

operationally connecting a plurality of hydraulically operated tools to a plurality of hydraulic control lines numbering less than or equal to the plurality of hydraulically operated tools, wherein each of the hydraulically operated tools is operable between at least two positions solely through hydraulic inputs, wherein each tool of the plurality of hydraulically operated tools is connected to only one of the plurality of control lines to receive the hydraulic inputs, the only one of the plurality of control lines being used to provide all hydraulic inputs, and connected to one of the other of the plurality of hydraulic control lines to which hydraulic fluid is discharged;

communicating the hydraulic input through one of the plurality of hydraulic control lines to at least one of the plurality of hydraulically operated tools;

actuating, in response to receiving the hydraulic input, at least one of the plurality of hydraulically operated tools from one of the at least two positions;

discharging hydraulic fluid from the at least one of the hydraulically operated tools to one of the other of the plurality hydraulic control lines from which the hydraulic input was received; and routing the discharged hydraulic fluid through the one of the other of the plurality of hydraulic control lines without venting the discharged hydraulic fluid into the wellbore.

19. The method of claim 18, wherein each of the plurality of hydraulically operated tools comprises a hydraulically piloted switch.

20. The method of claim 18, wherein:

the plurality of hydraulic control lines numbers less than the plurality of hydraulically operated tools; and at least two of the plurality of hydraulically operated tools are connected to a common hydraulic control line of the plurality of hydraulic control lines to receive the hydraulic inputs.

* * * * *